US005320319A

United States Patent [19]

Winger et al.

[11] Patent Number: 5,320,319

[45] Date of Patent: Jun. 14, 1994

[54] UNIVERSAL SUPPORT BRACKET FOR CONTAINERS

[75] Inventors: Timothy M. Winger, Lancaster; Michael C. Salamh, Pequea, both of Pa.

[73] Assignee: Novelty Manufacturing, Co., Lancaster, Pa.

[21] Appl. No.: 996,739

[22] Filed: Dec. 23, 1992

[51] Int. Cl.[5] ..... A47G 7/00

[52] U.S. Cl. ..... 248/312.1; 47/39

[58] Field of Search ..... 248/27.8, 295.1, 297.3, 248/312.1; 47/39, 67

[56] References Cited

U.S. PATENT DOCUMENTS 2,266,294 12/1941 Allderdice ..... 248/312.1 X 4,071,976 2/1978 Chernewski ..... 248/312.1 X

*Primary Examiner*—Douglas D. Watts

*Attorney, Agent, or Firm*—Martin Fruitman

[57] ABSTRACT

A universal support bracket is constructed to adjust to various heights and volumes of flower pots and other containers and to adapt to hanging on wood and wrought iron railings and wood and masonry surfaces. A shallow channel with slots in the web is formed into a right angle, and a strap with a series of holes and an end hook fits into one leg of the angle between the sides of the channel. Screws passing through the slots in the web and the holes in the strap are used to attach the channel to a back support and to also clamp it tightly against the strap, locking the hook over the top edge of a side of the container. A "U" clamp is used around both the angle and the hooked strap to attach the bracket to an upright of a wrought iron railing.

3 Claims, 3 Drawing Sheets

UNIVERSAL SUPPORT BRACKET FOR CONTAINERS

SUMMARY OF THE INVENTION

This invention deals generally with support brackets and more specifically with a universal bracket which will hold containers such as flower pots and window boxes of varying sizes.

Although window boxes and flower pots are common everyday items, they vary in size and, of course, are mounted on all sorts of surfaces and in varying situations. There are, in fact, at least three different types of flower box brackets in common use. First, there is the simple angle bracket. This device simply has a vertical leg attached to a vertical surface such as a wall or window sill, and a second, horizontal, leg is used to support the flower box much as a shelf would.

A second type of bracket is used to attach flower boxes to wrought iron railings. This bracket has a "U" shaped bend at one end which hangs over the top rail of the railing, while the horizontal flower box support has an extension rearward beyond the front vertical leg of the "U". This permits the rear edge of the horizontal support to rest against an upright of the wrought iron railing in order to prevent the support and the flower box from tipping forward.

A third type of bracket is similar to the bracket used on wrought iron railings, but its hook is specifically shaped with right angle corners to fit around and clamp onto the rectangular top rail of a wooden deck railing.

All of these brackets have problems in their utilization. The types which hang over rails must, of course, have the hook which fits over the rail sized to match the railing, so that they are not suitable unless the rail is of a standard size. Moreover, virtually all flower box brackets in use have the common problem of not furnishing a method of anchoring the flower box to the bracket. That means that accidental dislodging of a flower box and spilling the dirt and plants, particularly those hanging on railings, is quite common.

However, perhaps the most common problem is the requirement to decide upon the method of mounting the flower box before purchasing the bracket. For the do-it-yourself installer it can easily mean two trips to the hardware store, either to return the wrong type or wrong size bracket first purchased in error, or to go home to make measurements for the installation. For the merchant selling the brackets, this situation means, of course, that an impulse sale may be lost.

Finally there is another disadvantage of the flower box brackets commonly in use, and few people are even aware of it. It is that such brackets can only be used for flower boxes. Since the support member of each bracket is essentially a narrow strap, there is not even any thought of using only one of the two or more brackets usually used together in order to support a simple flower pot. The typical small pot would just fall off the narrow bracket.

The present invention not only solves the question of which bracket to purchase, but also prevents flower boxes from being knocked off of the brackets upon which they rest. Moreover, the bracket of the invention not only anchors any flower box it supports, but because it actually grips the container it supports, it easily supports and anchors any common flower pot, regardless of the size, configuration or material from which the flower pot is made.

This is accomplished by an adjustable bracket constructed from only three parts plus the nuts and bolts or screws used for mounting.

One part is an angle fixture formed from a shallow channel. This angle is bent to approximately a right angle, and is oriented so that the sides of the channel are on the outside of the angle. The angle fixture also has elongated slots in the web of one channel leg and two cutouts in the channel sides alongside one slot. The cutouts are opposite of each other and approximately the same size.

The second part of the bracket assembly is a narrow strap which fits into and slides within the channel leg which includes the slots. This strap has a hook formed into one end and a series of holes along its length. When properly placed within the slotted leg of the angle fixture, the hook of the strap is pointed at the other leg of the angle fixture.

Actually, when mounted on a vertical supporting surface such as a window sill, only mounting screws are required to complete the adjustable bracket and mount it. With one or more screws through the slots in the angle fixture and the holes in the strap, the angle fixture is clamped rigidly against the backing surface while the strap is prevented from moving by the screws through its holes.

A flower box, or even a simple flower pot can then be placed into and held fast within the bracket by placing the lip of the pot under the hook of the strap and pushing the pot bottom flat against the horizontal leg of the bracket. Different size flower pots or boxes can be accommodated by adjusting the extension of the strap as it fits into the channel leg so that the hook fits over the top of the side of the pot or box before mounting the bracket on its support surface.

The cutouts on the sides of the channel leg also permit the bracket to be mounted on the narrow uprights of a wrought iron railing. To accomplish this, a small "U" clamp, which fits into the cutouts is used to clamp the slotted leg of the angle fixture, with the strap within the channel, to an upright of an iron railing. A simple bolt with a nut is used to tighten the "U" clamp around the angle fixture, the strap and the upright of the railing.

The invention thereby provides a unique universal bracket which accommodates to either wooden or wrought iron railing and also to solid surfaces, while also rigidly anchoring both flower boxes and flower pots to prevent accidentally dislodging them. Moreover, the invention is easily adjustable to various size containers, so that it is clearly not limited to only flower boxes and flower pots.

DETAILED DESCRIPTION OF THE INVENTION

Figure 1:
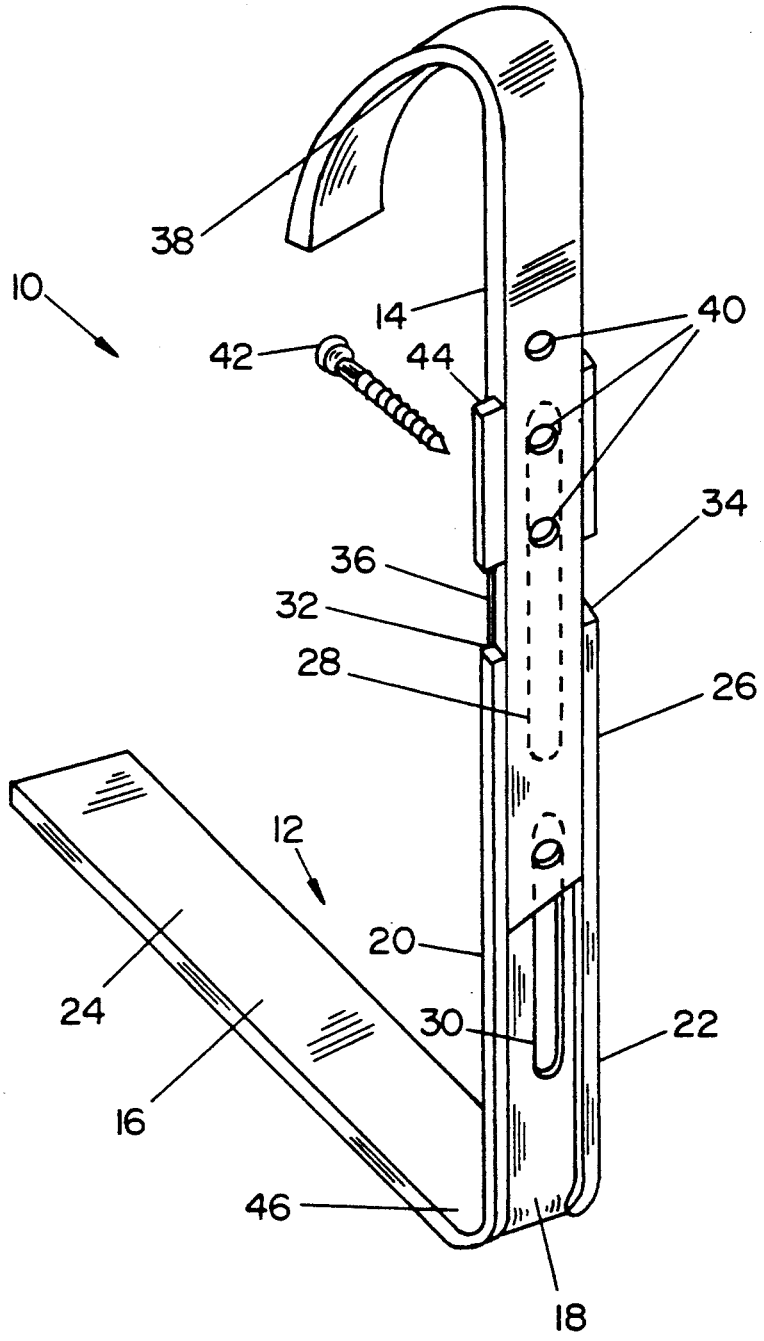
FIG. 1 is a perspective view of the universal bracket of the preferred embodiment.

FIG. 1 is a perspective view of the preferred embodiment of universal bracket 10 assembled from angle fixture 12 and hook strap 14.

Angle fixture 12 is formed of shallow channel 16 with web 18 and slides 20 and 22, and angle fixture 12 is bent into a right angle with sides 20 and 22 of the channel on the outside surfaces of legs 24 and 26. Angle fixture 12 also includes one or more slots 28 and 30 within web 18 of one of its legs 26, with slots 28 and 30 running essentially parallel to the length of leg 26 within which they are located.

Sides 20 and 22 of leg 26 also include cutouts 32 and 34 where short sections of sides 20 and 22 adjacent to web 18 are removed. Cutouts 32 and 34 are directly opposite from each other across web 18. Section 36 of web 18 is also modified adjacent to cutouts 32 and 34 so that it is slightly narrower at that location than where sides 20 and 22 remain intact.

Hook strap 14 is a simple strap of rectangular cross section with dimensions such that it fits between sides 20 and 22 of channel 16 with close tolerances. Hook 38 is formed at one end of hook strap 14 and one or more through holes 40 are formed in hook strap 14.

For the simplest method of utilizing universal bracket 10, the bracket as shown assembled in FIG. 1 is placed up against a vertical mounting surface to which it is to be attached, with channel sides 20 and 22 of angle leg 26 against the mounting surface (not shown). Screw 42 is then placed through slot 28 and through one of the holes 40 and screwed into the mounting surface. As screw 42 is tightened down it clamps both angle fixture 12 and hook strap 14 tightly against the mounting surface.

Because of slots 28 and 30 and the several holes 40 within angle leg 26, screw 42 can be located at any required position, and hook strap 16 can be slid along angle leg 26, so that the distance between horizontal angle leg 24 and hook 38 can be extended or shortened. Therefore, hook 38 can be adjusted to fit over the top edge of the side of virtually any container.

In actual use, the adjustment of hook strap 16 is accomplished quite simply by fitting universal bracket 10 onto the desired container (not shown) and marking the position of upper end 44 of leg 26 on the portion of hook strap 16 which is protruding just above upper end 44 of angle leg 26. The container is then removed from bracket 10 and the bracket is mounted on a surface as previously described with hook strap inserted into leg 26 up to the location previously marked. To place the container within bracket 10, it is then only necessary to tip the container so that the top edge of a side fits under hook 38, and to then push the lower edge of the container side toward corner 46 of bracket 10 until the container is positioned properly.

Figure 2:
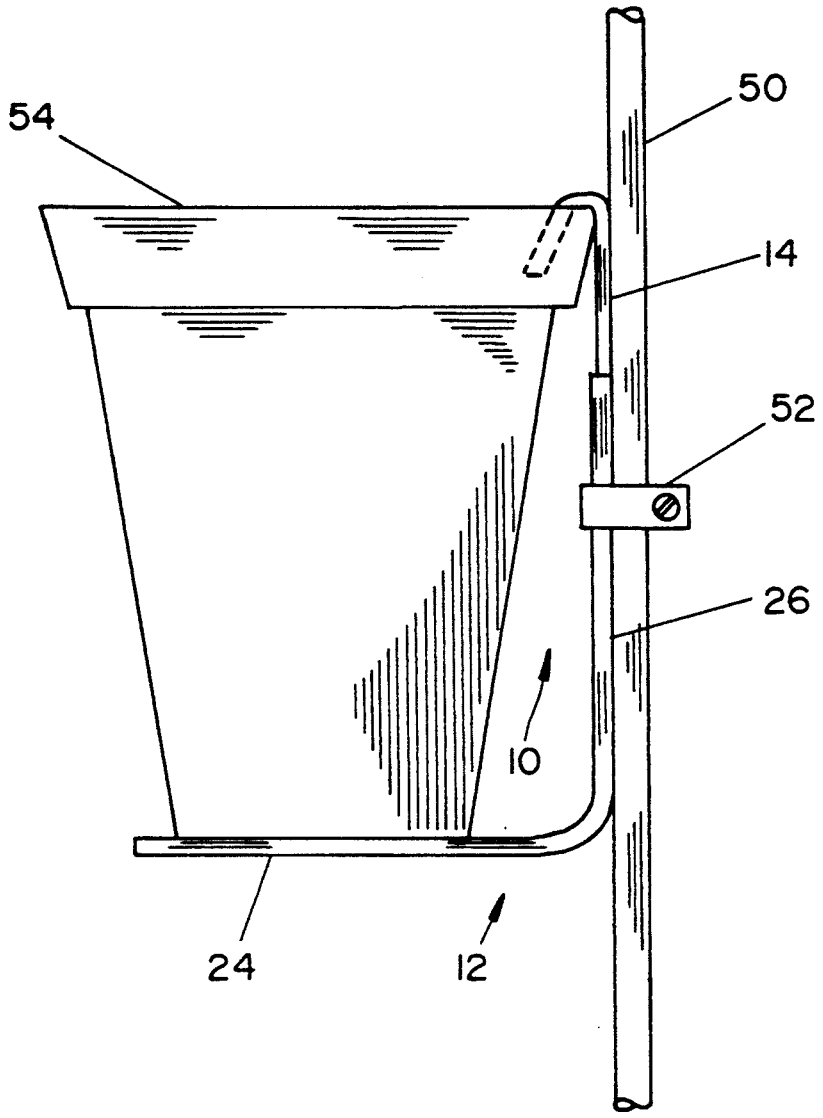
FIG. 2 is a side view of an alternate embodiment of the invention attached to a vertical rod.

FIG. 2 is a side view of an alternate embodiment of the invention in which universal bracket 10 is mounted upon vertical pole 50 by the use of "U" clamp 52 and holds container 54.

Figure 3:
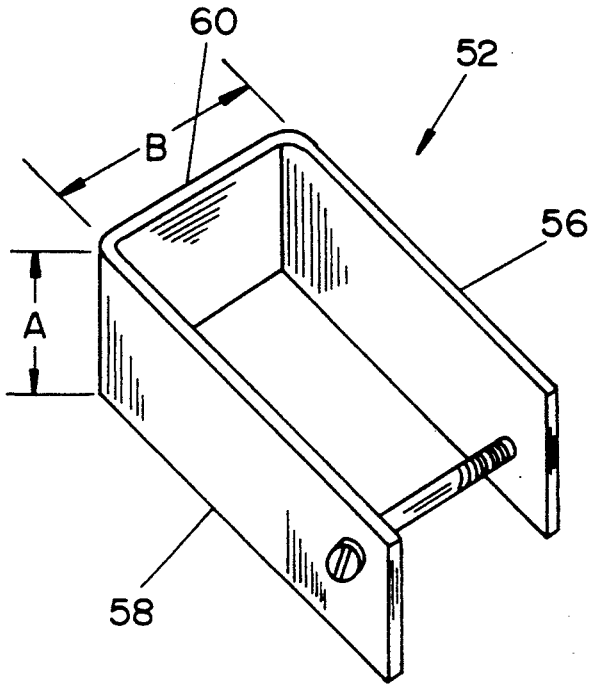
FIG. 3 is a perspective view of the "U" clamp used in the embodiment of FIG. 2.

As shown in FIG. 3, "U" clamp 52 is a simple "U" clamp constructed from strap metal legs 56 and 58 and "U" section 60 joining the legs, and preferably "U" clamp 52 has right angle corners. Width dimension A of the sides of clamp 52 is selected to be slightly smaller that the width of cutouts 32 and 34 (FIG. 1) on the sides of the channel configuration of angle leg 26, and spacing B, the length of "U" section 60, is selected to be approximately the same as the width of web section 36 (FIG. 1) between cutouts 32 and 34. Thus, when clamp 52 is located within cutouts 32 and 34 and tightened around pole 50 and leg 26 of universal bracket 10, clamp 52 also contacts hook strap 14 and locks it into position within angle leg 26.

As is clear from the above descriptions, universal bracket 10 can therefore serve to attach many sizes and styles of containers to both vertical surfaces and to vertical pole structures. The invention thereby solves the former problem of of requiring the user to know all the conditions of mounting a flower box or flower pot before purchasing a holding bracket.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims. For example a greater or lesser number of slots 28 and 30 or holes 40 may be used on the universal bracket.

What is claimed as new and for which Letters patent of the United States are desired to be secured is:

1. A support bracket for a container comprising:

an angle fixture formed from a first and a second leg joined at a right angle, with at least the first leg formed as a channel with two sides extending from the surface of the first leg remote from the second leg and a web joining the two sides, with at least one through slot in the web, and the slot extending along the first leg;

a strap including a straight section with a hook formed at one end, the straight section located between the sides of the channel of the first leg of the angle fixture, with the straight section also including at least one through hole which is aligned with a portion of a slot in the web;

a cutout within each side of the channel of one leg of the angle fixture, with the cutouts located opposite each other across the web of the channel and having a width extending along the leg;

a "U" clamp with two clamp sides, each of which has a width and a length, and a "U" section which has a length and joins the two clamp sides, with the length of the "U" section and the width of the clamp sides dimensioned so that the clamp sides are located within the cutouts in the sides of the channel and the lengths of the clamp sides are dimensioned so that the clamp sides extend beyond the sides of the channel; and clamping means acting to force the clamp legs together.

2. The support bracket of claim 1 wherein the clamping means is a bolt located through holes in the clamp sides, with a nut threaded onto the bolt and the holes in the clamp sides are located so that the holes are clear of the sides of the channel.

3. The support bracket of claim 1 wherein the web between the cutouts is narrower than the straight section of the strap which fits between the sides of the channel within which the cutouts are located.

* * * * *